US009333632B2

(12) United States Patent
Tanji

(10) Patent No.: US 9,333,632 B2
(45) Date of Patent: May 10, 2016

(54) PNEUMATIC NAIL DRIVER

(75) Inventor: Isamu Tanji, Hitachinaka (JP)

(73) Assignee: HITACHI KOKI CO., LTD., Tokyo (JP)

( * ) Notice: Subject to any disclaimer, the term of this patent is extended or adjusted under 35 U.S.C. 154(b) by 767 days.

(21) Appl. No.: 13/587,615

(22) Filed: Aug. 16, 2012

(65) Prior Publication Data

US 2013/0082082 A1 Apr. 4, 2013

(30) Foreign Application Priority Data

Sep. 30, 2011 (JP) ..... 2011-217903

(51) Int. Cl.
*B25C 1/04* (2006.01)
*B25C 5/13* (2006.01)

(52) U.S. Cl.
CPC ..... *B25C 1/044* (2013.01)

(58) Field of Classification Search
CPC ..... B25C 1/04; B25C 1/042; B25C 1/044; B25C 7/00; B25C 5/13; B25C 1/043
USPC ..... 227/8, 10, 130, 132, 142
See application file for complete search history.

(56) References Cited

U.S. PATENT DOCUMENTS 4,566,619 A * 1/1986 Kleinholz ..... 227/8
4,867,366 A 9/1989 Kleinholz
4,909,419 A * 3/1990 Yamada et al. ..... 227/1
7,431,187 B2 10/2008 Tachihara et al.
2012/0160889 A1* 6/2012 Tanji ..... 227/142

FOREIGN PATENT DOCUMENTS

JP 2004-351523 A 12/2004

OTHER PUBLICATIONS

Decision of Rejection Japanese Patent Application No. 2011-217903 dated Dec. 11, 2014.
The Notiifcation of the First Office Action Chinese Application/ Patent No. 2012102927361 dated Jul. 3, 2015 with English translation.

* cited by examiner

*Primary Examiner* — Michelle Lopez
(74) *Attorney, Agent, or Firm* — McDermott Will & Emery LLP

(57) ABSTRACT

A driver includes a housing in which an accumulator for accumulating compressed air is provided; a trigger provided in the housing; a cylinder stored in the housing; a piston stored to be slidable in the cylinder and driven by the compressed air; and a head valve moving in response to movement of the trigger between an acting position which is distant from the cylinder so that the compressed air acts on the piston and a blocking position which abuts against the cylinder so that the action of the compressed air on the piston is blocked. The cylinder can be arranged at a first position and a second position closer to the head valve than the first position in a state that the head valve moves from the blocking position to the acting position.

4 Claims, 11 Drawing Sheets

PNEUMATIC NAIL DRIVER

CROSS-REFERENCE TO RELATED APPLICATION

The present application claims priority from Japanese Patent Application No. 2011-217903 filed on Sep. 30, 2011, the content of which is hereby incorporated by reference into this application.

TECHNICAL FIELD OF THE INVENTION

The present invention relates to a driver in which a driving force to a fastener such as a nail or a staple driven by the driver is adjusted.

BACKGROUND OF THE INVENTION

There is a nail driver provided with a manual type adjuster for adjusting a driving depth so that a surface of a head portion of a nail that has been driven by the nail driver is in plane with a surface of a counterpart member (hereinafter referred to as "drive-receiving member") into which the nail has been driven. For example, a nail driver described in Japanese Patent Application Laid-Open No. 2004-351523 (Patent Document 1) includes an adjuster for adjusting a length of a push lever that abuts against a drive-receiving member, the adjuster by which a protrusion amount from an injection hole on a tip of the push lever of a driver blade that hits the nail is adjusted so as to adjust a driving depth.

Also, when the driving depth is adjusted by using the adjuster, a pressure of compressed air supplied from a compressor is used in a highly-adjusted pressure state often, and therefore, there is a problem that a life of the nail driver is shortened due to energy (excess energy), which has not been used for driving, among driving energy of a piston.

SUMMARY OF THE INVENTION

However, in the driver described in Patent Document 1, when the drive-receiving member is soft, a piston bumper deforms to absorb large excess energy so that the piston bumper is severely worn and an impact on a main body is also large. Therefore, this leads to a problem that degradation of durability of the piston bumper or the main body occurs.

The present invention has been made in consideration of these problems, and preferred aims thereof are to achieve easy switching of a driving depth of a nail and achieve adjustment of a driving energy at the same time, and besides, achieve reduction in air consumption.

In order to achieve the above-described preferred aims, there is provided the driver according to the present invention including: a housing provided with an accumulator for accumulating compressed air; a trigger provided to the housing; a cylinder stored in the housing; a piston stored to be slidable in the cylinder and driven by the compressed air; and a main valve moving in response to movement of the trigger between an acting position which is distant from the cylinder so that the compressed air acts on the piston and a blocking position which abuts against the cylinder so that the action of the compressed air on the piston is blocked, and the cylinder can be positioned at a first position and a second position closer to the main valve than the first position in a state that the main valve moves from the blocking position to the acting position.

Here, it is preferred that the cylinder is movable between the first position and the second position by the compressed air.

It is preferred that the driver further includes: a bumper which can abut against the piston; and a bumper holder provided below the bumper for supporting the bumper and slidable to the housing, an air passage extending from the accumulator to the bumper holder is formed in the housing, the bumper holder is moved to the cylinder side by the compressed air so as to define a bumper lower chamber below the bumper holder, and the cylinder is moved from the first position to the second position in accordance with the movement of the bumper holder.

Also, it is preferred that the driver further includes: a valve member for opening and closing the air passage; and a switching portion including a switching knob for switching the valve member to a position of opening the air passage or a position of closing the air passage.

Moreover, it is preferred that a movement restricting portion is provided to the housing, an abutting portion positioned below the movement restricting portion is provided to the cylinder, and the abutting portion abuts against the movement restricting portion when the cylinder is at the second position so as to restrict approach of the cylinder to the main valve.

In another viewpoint of the present invention, there is provided a driver including: a housing provided with a first air chamber defined for accumulating compressed air; a cylinder stored in the housing; a piston stored to be slidable in the cylinder, which is driven by the compressed air; and an exhaust switching mechanism provided below the cylinder, a second air chamber which communicates with the cylinder and moves in response to movement of the piston for accumulating air exhausted from an inside of the cylinder is formed in the housing, and the exhaust switching mechanism can switch a cross-sectional area of an air passage extending from the cylinder to the second air chamber.

Also, it is preferred that the exhaust switching mechanism includes: a bumper which can abut against the piston; and a bumper holder provided below the bumper for supporting the bumper and slidable to the housing, a first air passage extending from the first air chamber to the bumper holder is formed in the housing, a second air passage which communicates between an inside of the cylinder and the second air chamber is formed in the cylinder, the bumper holder moves to the cylinder side by the compressed air coming from the first air passage so as to define a bumper lower chamber, and the bumper moves in accordance with the movement of the bumper holder so that a cross-sectional area of an air passage extending from the inside of the cylinder to the second air chamber can be switched. Moreover, it is preferred that the driver further includes a movement restricting portion against which the bumper holder abuts for restricting upward movement of the bumper holder when the bumper holder moves to the bumper side so as to define the bumper lower chamber together with the housing.

Moreover, it is preferred that the movement restricting portion is the cylinder, the cylinder includes a flange portion which is annularly provided on an outer peripheral surface thereof so as to abut against an inner peripheral wall of the housing, a pressure receiving area of the flange portion for the compressed air is larger than a pressure receiving area of the bumper holder for the compressed air in defining the bumper lower chamber, and a lower end of the cylinder abuts against the housing.

According to the present invention, it is possible to provide a driver capable of easy switching of a driving depth of a nail and adjusting of a driving energy at the same time, and besides, achieving reduction in air consumption.

BRIEF DESCRIPTIONS OF THE DRAWINGS

DESCRIPTIONS OF THE PREFERRED EMBODIMENTS

A driver according to a first embodiment of the present invention will be explained with reference to the drawings below. A nail driver 1 illustrated in FIG. 1, which is one example of the driver, is a tool for driving a nail which is a fastener with using compressed air as motive power.

Figure 1:
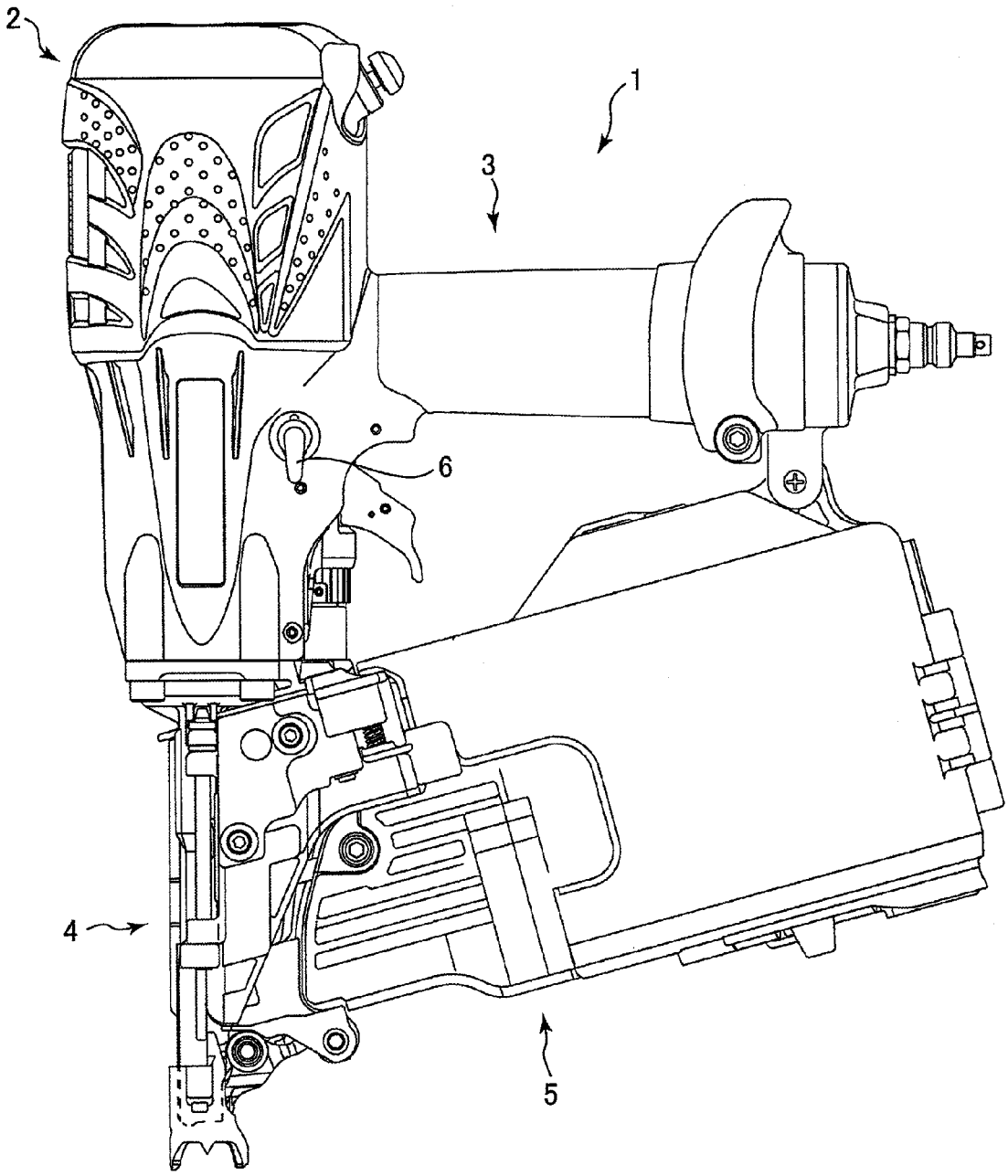
FIG. 1 is a front view illustrating appearance of a nail driver according to a first embodiment of the present invention.
Figure 2:
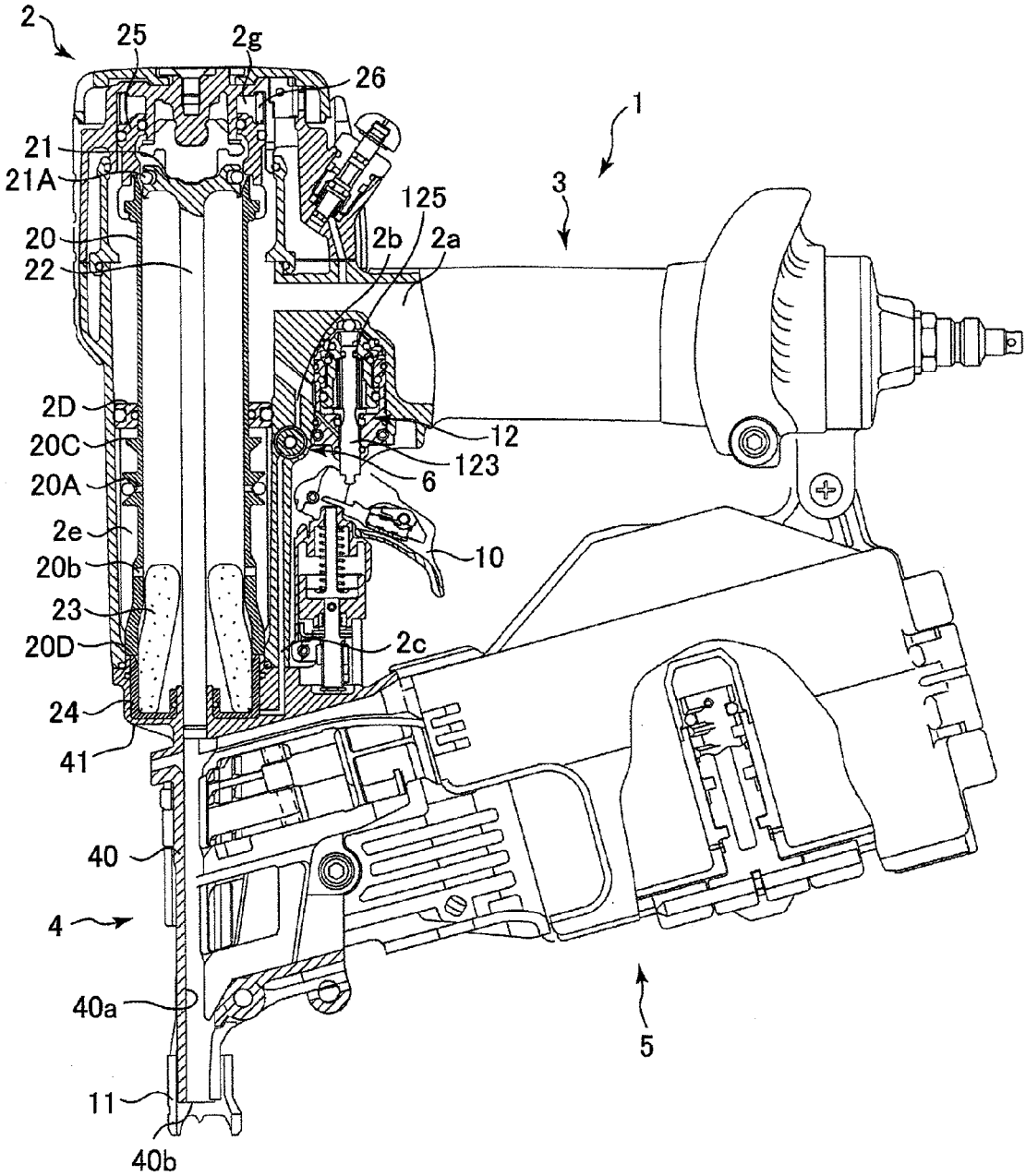
FIG. 2 is a partial cutaway front view of the nail driver according to the first embodiment of the present invention.

As illustrated in FIGS. 1 and 2, the nail driver 1 mainly includes: a main body 2; a handle portion 3 extending in a substantially perpendicular direction with respect to a sliding direction of a piston 21 described later; a nose portion 4 positioned in a substantially perpendicular direction with respect to a drive-receiving member (not illustrated) in the driving; a magazine 5 for holding a nail to be supplied to the nose portion 4; and a switching portion 6 for switching a driving force. Note that, hereinafter, a direction which is a sliding direction of the piston 21 heading from the main body 2 to the nose portion 4 is referred to as a "downward direction", and a direction opposite to the direction is referred to as an "upward direction". Also, the housing is formed of the main body 2 and the handle portion 3.

As illustrated in FIG. 2, an accumulator 2*a* for accumulating the compressed air is formed inside the main body 2 and the handle portion 3 of the nail driver 1. The accumulator 2*a* is connected to an air compressor (not illustrated) so as to interpose an air hose (not illustrated) therebetween for accumulating the compressed air from the air compressor. A first air passage 2*b* and a second air passage 2*c* are formed in vicinity of the switching portion 6 of the main body 2. Also, an exhaust port communicating with an outside which is not illustrated is formed on an upper portion of the main body 2.

At a connecting portion between the main body 2 and the handle portion 3, a trigger 10 which is operated by an operator, a push lever 11 which protrudes from a lower end of the nose portion 4 and extends to a vicinity of the trigger 10, and a trigger valve portion 12 which is a switch valve communicating with a head valve chamber 2*g* described later for supplying and exhausting the compressed air are provided.

The push lever 11 is biased from the main body 2 toward the nose portion 4 side so as to be moveable upward and downward along the nose portion 4. A control path which is not illustrated is formed in the main body 2, and the trigger valve portion 12 is connected to the head valve chamber 2*g* described later by the control path. By performing an operation of pushing a lower end portion of the push lever 11 onto the drive-receiving member, an upper end portion of the push lever 11 makes a push lever plunger 11*a* move in an upward direction. An upper end portion of the push lever plunger which has been moved in the upward direction abuts against an arm plate 10*a*. By performing a pulling operation of the trigger 10 in this state, the arm plate is abutted against a plunger 123 of the trigger valve portion 12 to move the same in the upward direction. In this manner, the compressed air acts on the piston 21 to perform a driving operation.

When both of the pulling operation of the trigger 10 and the pushing operation of the push lever 11 onto the drive-receiving member are performed, the plunger 123 is pushed up.

The trigger valve portion 12 includes: a valve bush 121; a valve piston 122; the plunger 123; a spring 124; and O-rings 125 and 126. In a state that the pulling operation of the trigger 10 and the pushing operation of the push lever 11 have not been performed, the valve piston 122 is positioned at the upper dead point, and the plunger 123 is positioned at the lower dead point. In this state, a space between the valve piston 122 and the O-ring 125 is closed so that the trigger valve chamber 127 is blocked from atmosphere while the compressed air inside the accumulator 2*a* is flown into the trigger valve chamber 127 from a space between the plunger 123 and the O-ring 126. And, the compressed air is also flown into the head valve chamber 2*g* communicating with the trigger valve chamber 127. Also, in a state that both of the pulling operation of the trigger 10 and the pushing operation of the push lever 11 have been performed, the valve piston 122 is positioned at the lower dead point, and the plunger 123 is positioned at the upper dead point. In this state, the space is formed between the valve piston 122 and the O-ring 125 so that the trigger valve chamber 127 communicates with the atmosphere to exhaust the compressed air inside the trigger valve chamber 127. Also, the space between the plunger 123 and the O-ring 126 is closed so that the trigger valve chamber 127 is blocked from the accumulator 2*a*. And, the head valve chamber 2*g* communicating with the trigger valve chamber 127 communicates with the atmosphere through a control path which is not illustrated so as to exhaust the compressed air inside the head valve chamber 2*g*.

The main body 2 includes, in its inside: a cylindrical cylinder 20; a piston 21 which is slidable (reciprocatable) upward and downward inside the cylinder 20; a driver blade 22 which is substantially monolithically formed with the piston 21; a piston bumper 23 provided at a lower end portion of the cylinder 20; a bumper holder 24 provided below the piston bumper 23; and a head valve 25. The head valve 25 corresponds to the "main valve" in the present invention.

Figure 7:
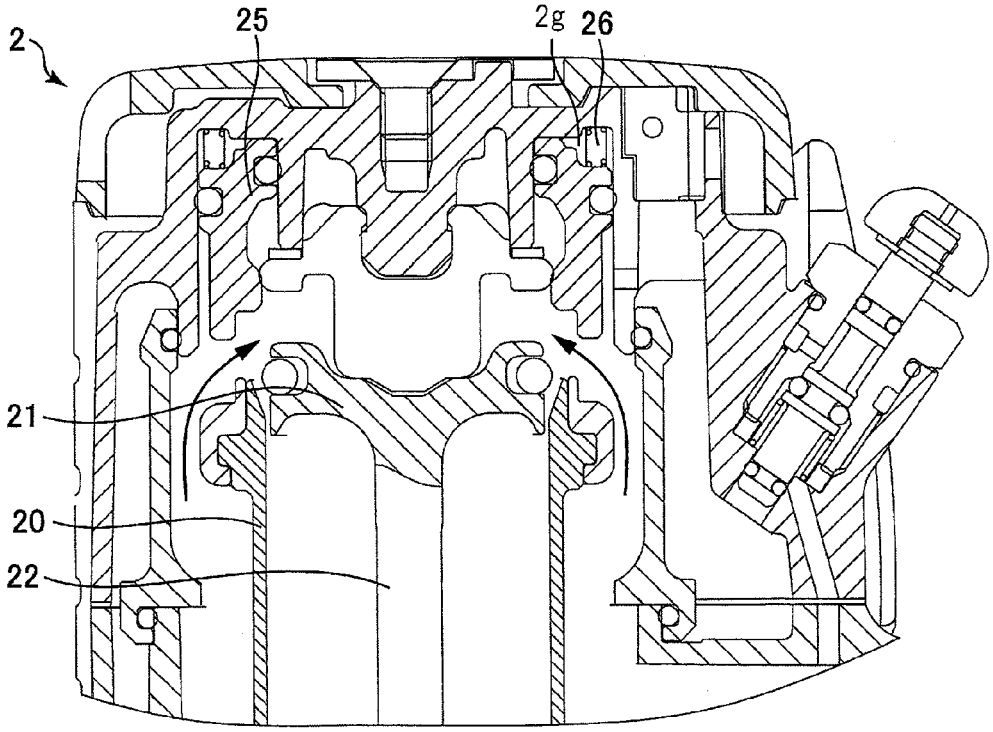
FIG. 7 is a view illustrating a state that compressed air acts on a piston in a state that a cylinder is positioned at a lower dead point.

The cylinder 20 can be positioned at the upper dead point (FIG. 8) and the lower dead point (FIG. 7). An inner surface of the cylinder 20 supports so that the piston 21 is slidable, and an annular cylinder plate 2D is provided between an outer periphery of the cylinder 20 and an inner surface of the main body 2. The cylinder plate 2D divides a space between the cylinder 20 and the main body 2 into upper and lower spaces, and besides, seals between the upper space and the lower space with using an O-ring. The upper space forms the accumulator 2*a* together with a space inside the handle portion 3.

Also, the lower space forms a return air chamber 2*e* for storing compressed air required for returning the piston 21 to the upper dead point. A check valve 20A is provided at a central portion of the cylinder 20 in a shaft direction, and the compressed air is allowed to flow in only one direction from the inside of the cylinder 20 to the return air chamber 2*e* outside the cylinder 20. Also, a third air passage 20*b* which always opens for the return air chamber 2*e* is formed below the cylinder 20. Further, in the cylinder 20, an abutting portion 20C which is positioned below the cylinder plate 2D and which protrudes outward in a radial direction from the outer peripheral surface. Still further, a lower end portion of the cylinder 20 includes a striking portion 20D.

The piston 21 is slidable in upward and downward directions between the upper dead point and the lower dead point inside the cylinder 20. An O-ring 21A is provided on an outer periphery of the piston 21. The O-ring 21A seals between the piston 21 and the cylinder 20. Also, the driver blade 22 is monolithically formed with the piston 21 so as to extend downward from substantially a center of a lower surface of the piston 21. Further, the inside of the cylinder 20 is partitioned into a piston upper chamber and a piston lower chamber by the piston 21. When the compressed air acts on the piston 21 in the driving, the driver blade 22 rapidly descends together with the piston 21 so as to move through an injection passage 40*a*, so that the driving force is applied to the nail.

The piston bumper 23 is a lower end portion of the cylinder 20, and is provided in vicinity of the lower dead point of the piston 21. The piston bumper 23 is made of a flexible material such as rubber, and absorbs energy (excess energy) obtained by subtracting energy which has been consumed by the driving of the nail from a driving energy contained in the piston 21 which has been descended by the compressed air. Also, the piston bumper 23 includes a through hole which protrudes through a central shaft of the cylinder 20 and into which the driver blade 22 is inserted, and an outer peripheral surface of the piston bumper 23 has a tapered shape so as to be inclined such that an outer diameter thereof is smaller as heading upward.

Figure 3:
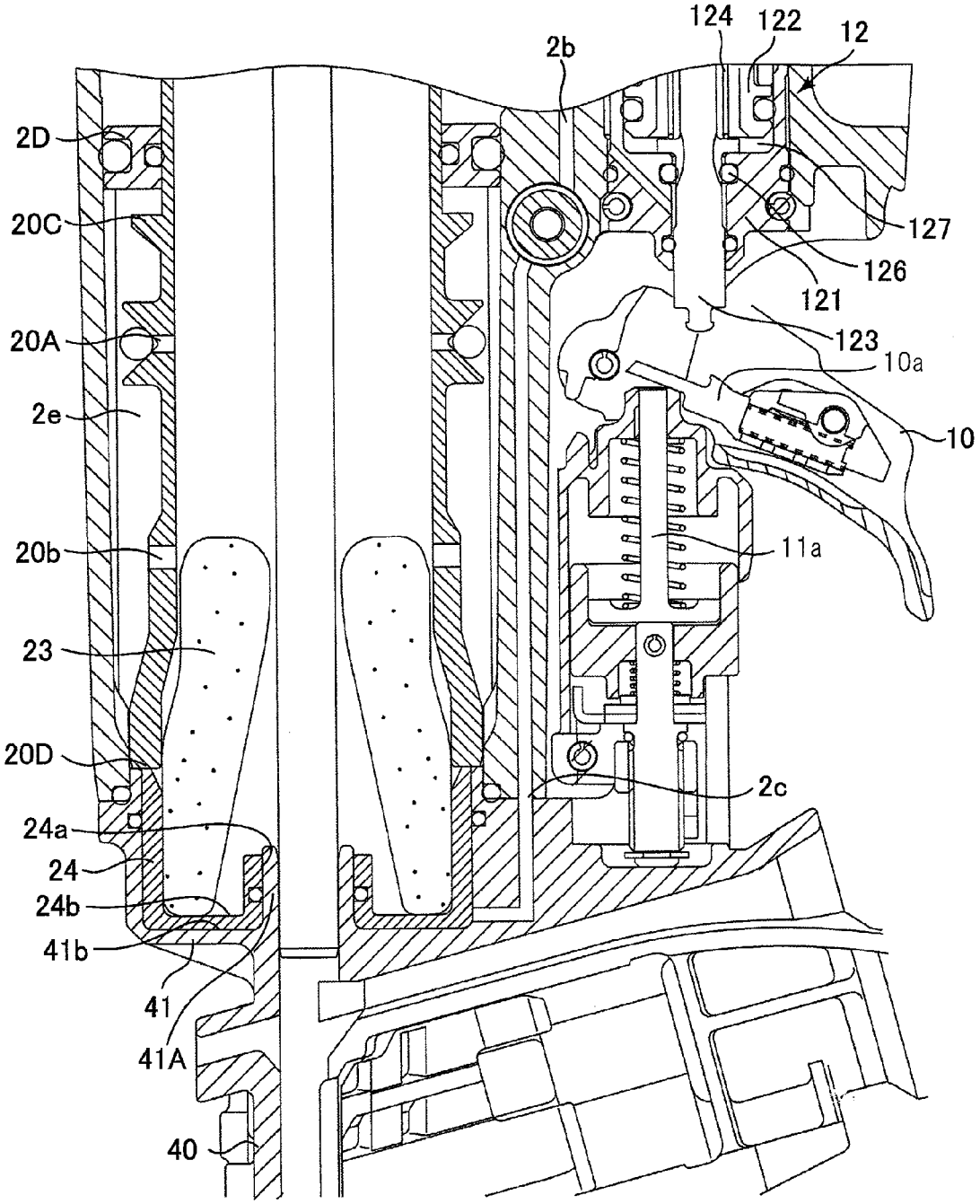
FIG. 3 is an enlarged view of a principal part in a state that no compressed air flows into a bumper lower chamber in the first embodiment.

As illustrated in FIG. 3, the bumper holder 24 is provided below the piston bumper 23, and supports the piston bumper 23 to slide in the upward and downward directions. The bumper holder 24 is annularly formed so that a through hole 24*a* into which the driver blade 22 is inserted is formed in a central portion thereof. Also, the bumper holder 24 includes a concave portion 24*b* which is annular downward concave and supports a lower end portion of the piston bumper 23. Further, an outer peripheral upper end portion of the bumper holder 24 abuts against the striking portion 20D of the cylinder 20.

Figure 4:
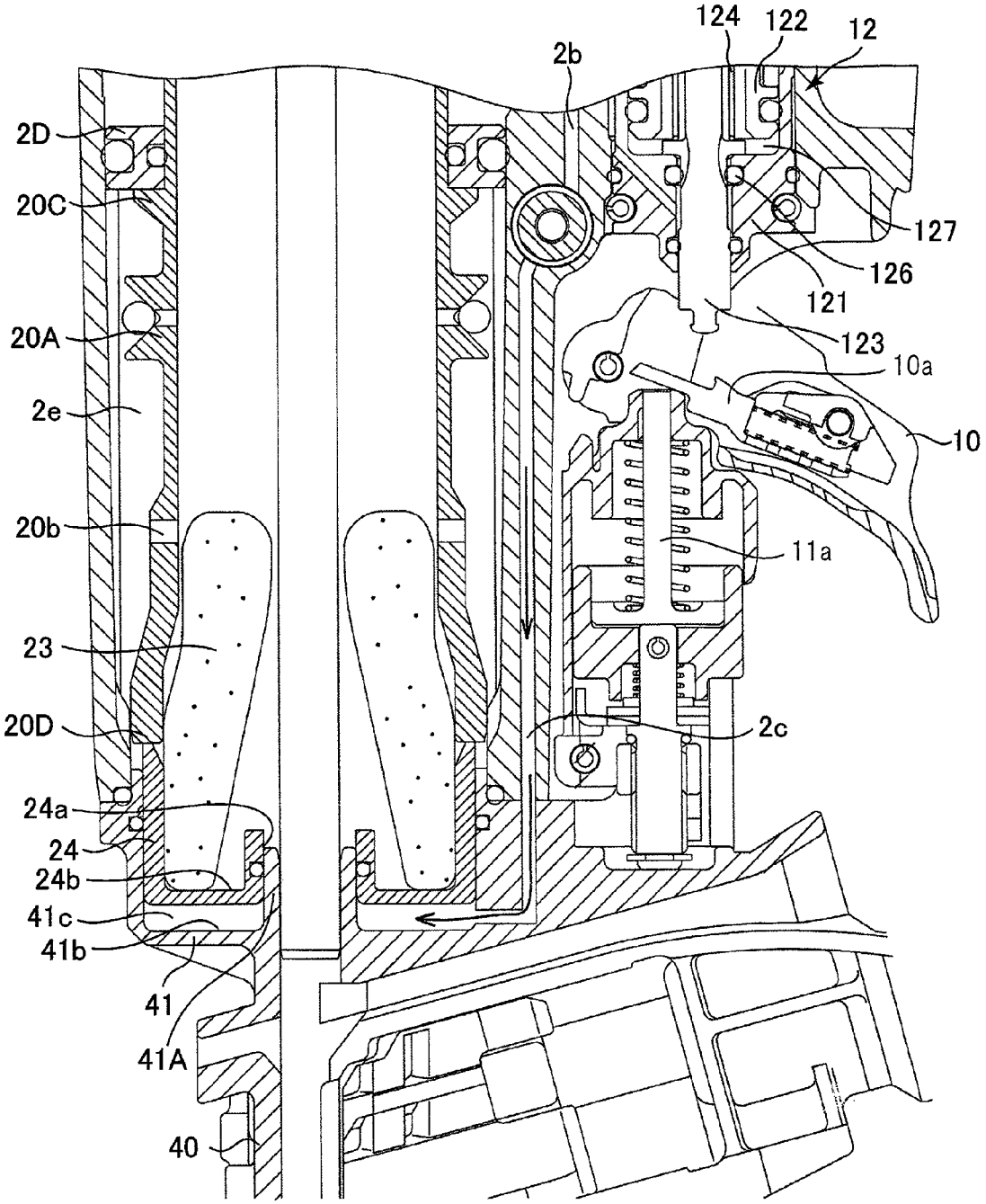
FIG. 4 is an enlarged view of a principal part in a state that the compressed air flows into the bumper lower chamber in the first embodiment.

Still further, as illustrated in FIG. 4, when the compressed air has flown below the bumper holder, the bumper holder 24 moves upward so as to define a bumper lower chamber 41*c* together with a concave portion 41*b* of the nose portion 4 described later. When the bumper holder 24 moves upward, the cylinder 20 is pushed upward. However, when the abutting portion 20C of the cylinder 20 abuts against the cylinder plate 2D, the upward movements of the bumper holder 24 and the cylinder 20 are stopped, and the approach of the cylinder 20 toward the head valve 25 is restricted. Note that, in the state that the abutting portion 20C has abutted against the cylinder plate 2D, the cylinder 20 is positioned at the upper dead point. The O-ring provided around the bumper holder 24 seals between the bumper lower chamber 41*c* and the inside of the main body 2, and the flow of the compressed air into the bumper lower chamber 41*c* is controlled by the switching portion 6.

Figure 8:
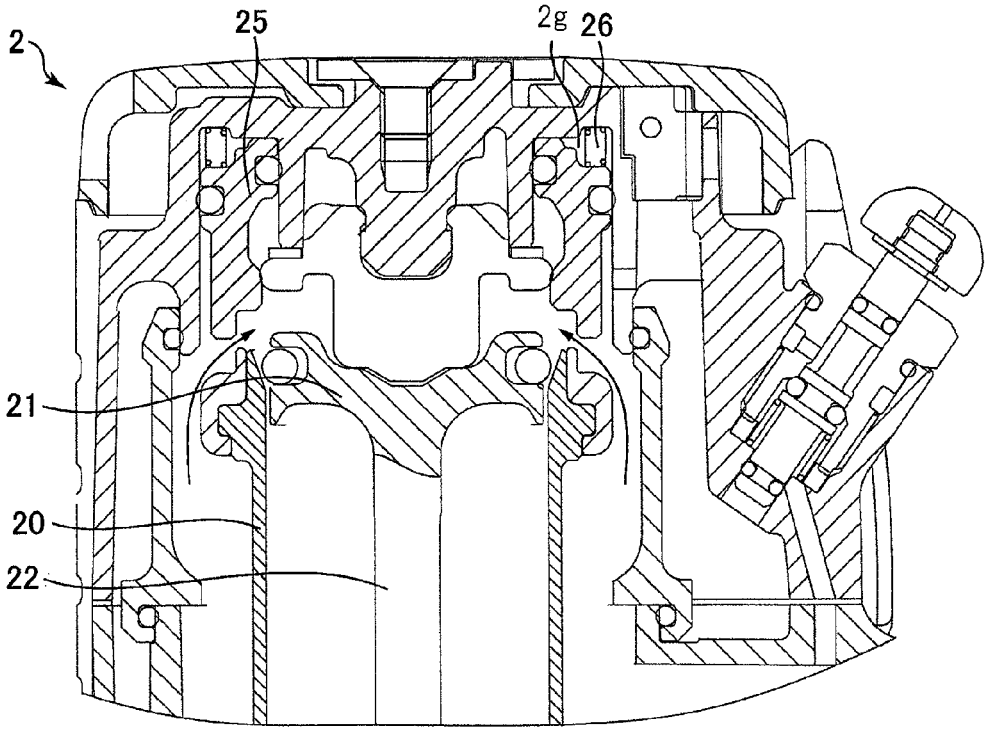
FIG. 8 is a view illustrating a state that the compressed air acts on the piston in a state that the cylinder is positioned at an upper dead point.

As illustrated in FIG. 2, the head valve 25 is arranged on an upside of the cylinder 20, and an air passage not illustrated which can communicate with an exhaust port not illustrated is formed. A head valve chamber 2*g* into which the head valve 25 is stored is formed in the main body 2, and the head valve chamber 2*g* communicates with the trigger valve portion 12 so as to interpose a control passage not illustrated therebetween. In the head valve chamber 2*g*, a head valve spring 26 for biasing the head valve 25 downward is arranged. In an initial state as illustrated in FIG. 2, the head valve chamber 2*g* is filled with the compressed air, and the head valve 25 is biased downward by the head valve spring 26 and the compressed air inside the head valve chamber 2*g*. The force with which the head valve spring 26 biases the head valve 25 downward is smaller than the force with which the compressed air of the accumulator 2*a* pushes the head valve 25 upward. Therefore, as illustrated in FIG. 7, when the compressed air of the head valve chamber 2*g* is released to become atmospheric pressure, the head valve 25 is moved upward by the compressed air so as to act against the biasing force of the head valve spring 26. Note that the valve head 25 in FIG. 2 is positioned at the blocking position so as to abut against the cylinder 20 for blocking the action of the compressed air on the piston 21, and that the head valve 25 in each of FIGS. 7 and 8 is positioned at the acting position so as to be distant from the cylinder 20 for acting the compressed air on the piston 21.

As illustrated in FIG. 2, the nose portion 4 guides the nail and the driver blade 22 so that the driver blade 22 can suitably contact the nail to drive the same into a desired position of the drive-receiving member. The nose portion 4 includes: an injection portion 40; and a connecting portion 41 for connecting the injection portion 40 and the main body 2. Note that the push lever 11 is provided to be movable in the upward and downward directions along an outer surface of the injection portion 40.

The injection portion 40 guides the driver blade 22 and the nail so that the nail is driven downward, the nail being supplied from the magazine 5 in which a bundle of nails obtained by bundling and coupling a plurality of nails is stored. The injection portion 40 includes an injection passage 40*a* therein through which the nail and the driver blade 22 are guided. Also, the injection portion 40 includes an injection hole 40*b* at a tip portion thereof in the downward direction through which the nail is injected.

The connecting portion 41 is provided so as to cover a lower opening portion of the main body 2. As illustrated in FIGS. 2 and 3, a tubular portion 41A into which the driver blade 22 is inserted is provided on an upper surface of the connecting portion 41 so as to protrude inward of the main body 2. Also, the concave portion 41*b* which is annular downward concave is formed around the tubular portion 41A. The bumper holder 24 fits to the concave portion 41*b*. Further, as illustrated in FIG. 4, a bumper lower chamber 41*c* is defined by the concave portion 41*b* and the lower surface of the bumper holder 24.

The magazine 5 stores the plurality of nails, and is provided below the handle portion 3 as illustrated in FIG. 2. The nails stored in the magazine 5 are sequentially fed to the injection passage 40*a* by a feeder which can be reciprocated by the compressed air and an elastic member.

Figure 5:
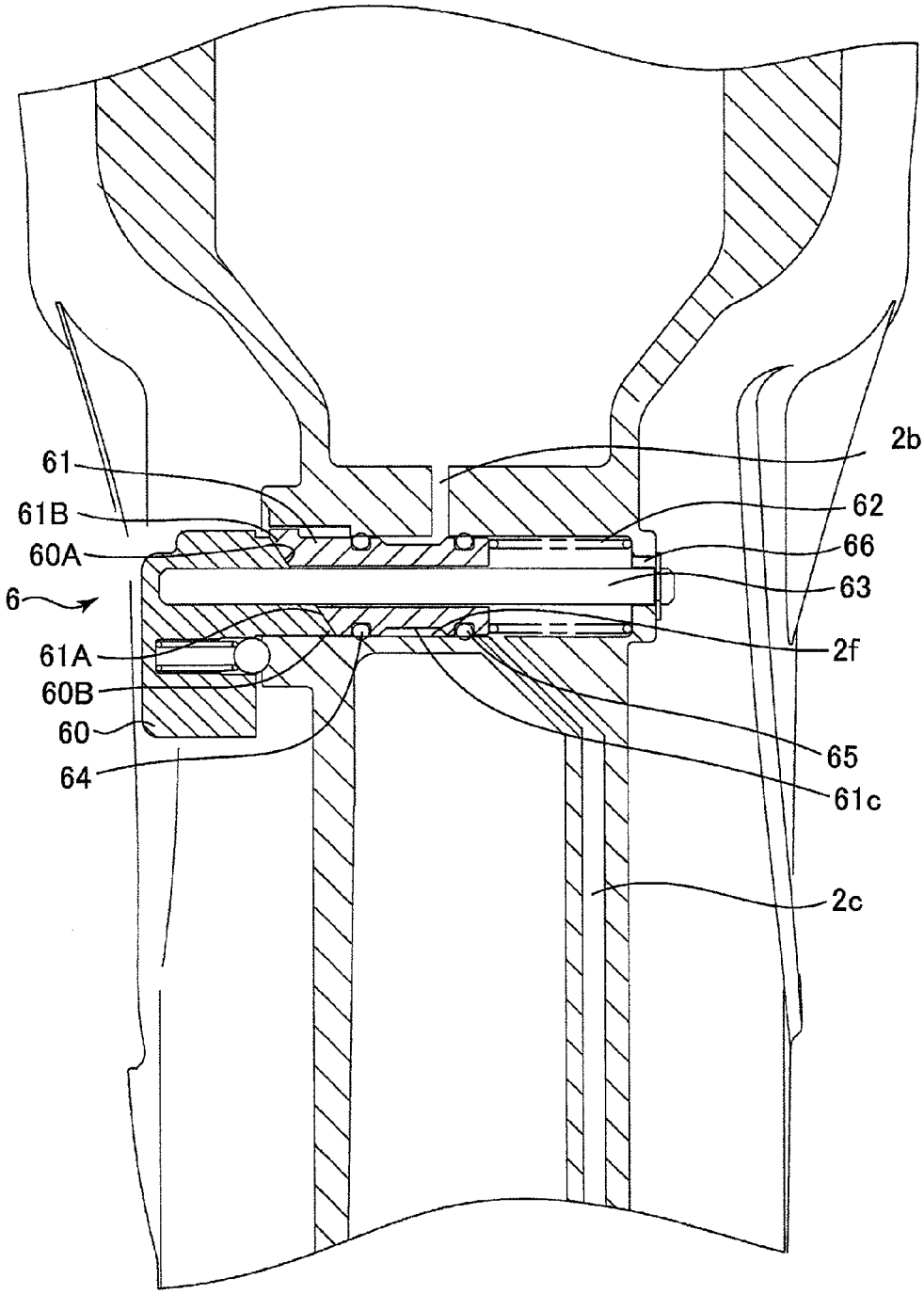
FIG. 5 is a cross-sectional schematic view of a switching portion in a state that a first air passage does not communicate with a second air passage.
Figure 6:
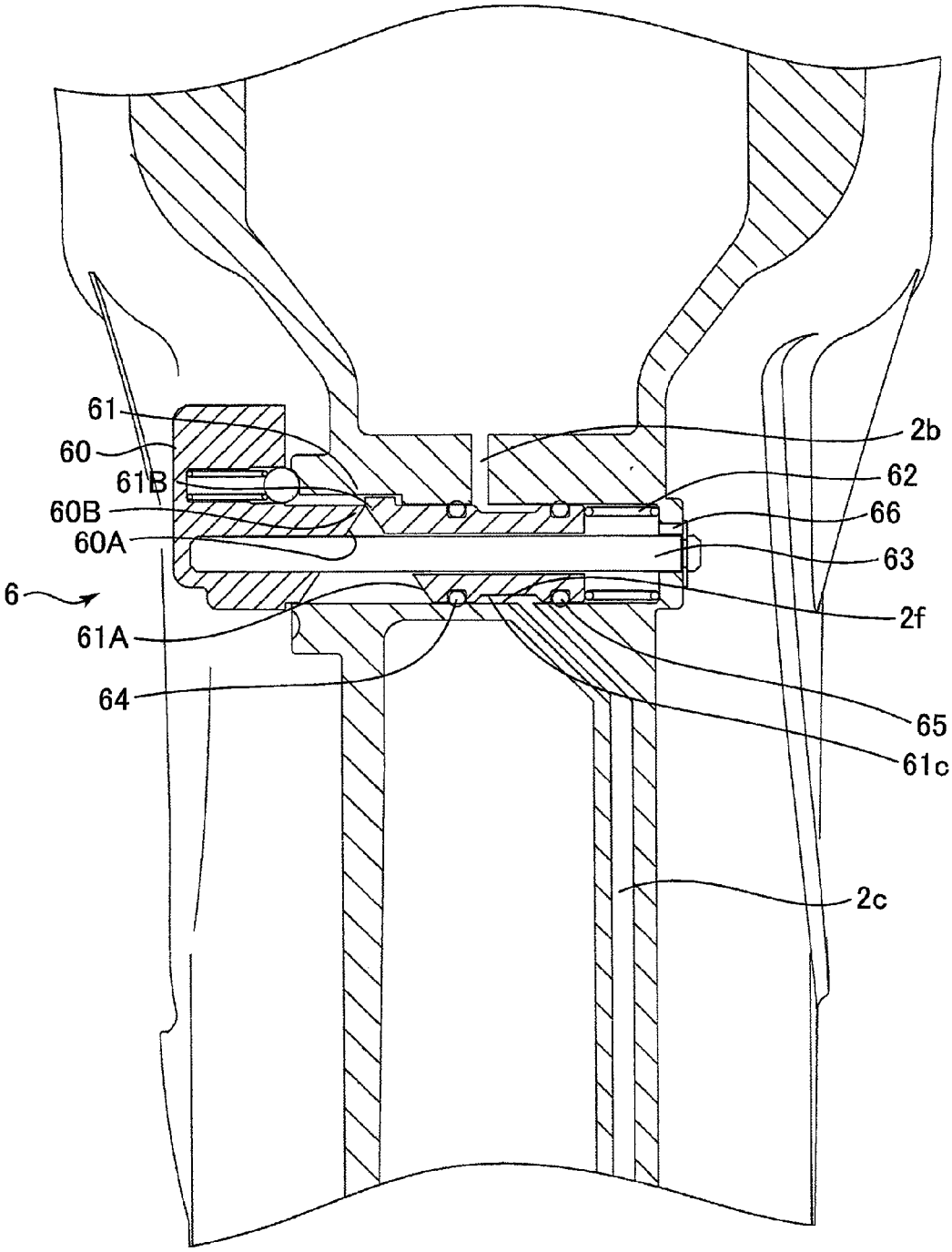
FIG. 6 is a cross-sectional schematic view of a switching portion in a state that the first air passage communicates with the second air passage.

The switching portion 6 is a valve for switching to communicate and block between the first air passage 2*b* communicating with the accumulator 2*a* and the second air passage 2*c* communicating with the bumper lower chamber 41*c*. As illustrated in FIGS. 5 and 6, the switching portion 6 includes: a switching knob 60; a valve member 61; the spring 62; and a rotating shaft portion 63.

The switching knob 60 is a portion operated by the operator for adjusting the driving force, and is provided to be rotatable with respect to the main body 2 around the rotating shaft portion 63. An end portion of the switching knob 60 which is opposite to the valve member 61 has a tapered surface 60A which is inclined with respect to the central shaft of the rotating shaft portion 63. Also, the switching knob 60 includes a protruding portion 60B of the tapered surface 60A which protrudes towards the valve member 61.

The valve member 61 is slid through a passage 2*f* formed in the main body 2 by a rotating operation of the switching knob 60 so as to communicate or block between the first air passage 2*b* and the second air passage 2*c*. An end portion of the valve member 61 which is opposite to the switching knob 60 has a tapered surface 61A which is inclined with respect to the central shaft of the rotating shaft portion 63. Also, the valve member 61 includes a protruding portion 61B of the tapered surface 61A which protrudes towards the switching knob 60. Further, a concave portion 61*c* which is concave in an inner radial direction is annularly formed on an outer peripheral portion of the valve member 61. Still further, in the valve member 61, O-rings 64 and 65 for sealing the passage for the compressed air formed by the concave portion 61*c* from the atmosphere are provided so as to interpose the concave portion 61*c*.

The spring 62 is provided inside the passage 2*f*, and biases the valve member 61 in a direction heading toward the switching knob 60 (in a leftward direction in FIGS. 5 and 6). Also, the rotating shaft portion 63 supports the switching knob 60 so that it is rotatable with respect to the main body 2.

In a state as illustrated in FIG. 5, the switching knob 60 abuts against the valve member 61 in a state that the inclining direction of the tapered surface 60A and the inclining direction of the tapered surface 61A of the valve member 61 are substantially equal to each other. In this state, the communication between the first air passage 2*b* and the second air passage 2*c* is blocked. And, the second air passage 2*c* communicates with the atmosphere through an exhaust port 66. When the switching knob 60 is rotated by substantially 180 degrees from this state, the protruding portion 60B of the tapered surface 60A of the switching knob 60 which protrudes toward the valve member 61 moves along the tapered surface 61A of the valve member 61, and therefore, the valve member 61 moves in a direction so as to be distant from the switching knob 60 and act against the spring 62 (in a rightward direction in FIG. 6). And, as illustrated in FIG. 6, the protruding portion 60B of the switching knob 60 abuts against the protruding portion 61B of the valve member 61. In this state, the first air passage 2*b* and the second air passage 2*c* communicate with each other so as to interpose the concave portion 61*c* therebetween. And, the compressed air inside the accumulator 2*a* flows into the second air passage 2*c* through the first air passage 2*b* and the concave portion 61*c* of the switching portion 6. In this manner, the bumper holder 24 moves upward so as to define the bumper lower chamber 41*c* together with the concave portion 41*b* and the lower surface of the bumper holder 24.

Next, an operation of the nail driver 1 according to the present embodiment will be explained.

First, an operation of the nail driver 1 performed when a relatively long nail is driven will be explained. In this case, the operator performs the rotating operation of the switching knob 60 so that the switching knob 60 is positioned in a state as illustrated in FIG. 5, that is, a state that the tapered surface 60A of the switching knob 60 and the tapered surface 61A of the valve member 61 abut against each other so that their inclining angles are substantially equal to each other. In this manner, the first air passage 2*b* and the second air passage 2*c* are blocked from each other. Therefore, the compressed air inside the accumulator 2*a* does not flow below the bumper holder 24, so that the bumper lower chamber 41*c* is not defined. Therefore, the bumper holder 24 and the cylinder 20 do not move upward. Also, the compressed air inside the accumulator 2*a* flows into the head valve chamber 2*g* through a control passage not illustrated so as to push the head valve 25 downward, so that the head valve 25 and the cylinder 20 are in close contact with each other so as to prevent the flowing of the compressed air into the cylinder 20. In other words, the main valve, that is, the head valve 25 is positioned at the blocking position by the compressed air. Also, the cylinder 20 is biased downward by the head valve 25 and the head valve spring 26 to be positioned at the lower dead point.

When the operator pulls the trigger 10 with pressing the push lever 11 onto the drive-receiving member, the plunger 123 is pushed up, and the control passage not illustrated is communicated with the atmosphere by the trigger valve portion 12, so that the pressure of the head valve chamber 2*g* is the atmospheric pressure. The head valve 25 is moved from the blocking position (FIG. 2) to the distant position (FIG. 7) by a pressure difference between the compressed air accumulated in the accumulator 2*a* and the head valve chamber 2*g*. In this manner, as indicated by an arrow in FIG. 7, the compressed air accumulated in the accumulator 2*a* flows from the space between the head valve 25 and the cylinder 20, and acts on the piston 21 so as to push the piston 21 downward.

In this manner, the piston 21 descends downward through the cylinder 20 while the driver blade 22 descends downward through the injection passage 40*a*, so that the nail inside the injection passage 40*a* is hit. At this time, air in the piston lower chamber flows into the return air chamber 2*e* through the air passage 20*b*. And, when the piston 21 passes the check valve 20A, a part of the compressed air inside the piston upper chamber flows into the return air chamber 2*e* through the check valve 20A so as to be used to return the piston 21 to the upper dead point. Further, the nail descended together with the driver blade 22 is driven into the drive-receiving member. At this time, in the nail driver 1, the bumper lower chamber 41*c* is not defined, and therefore, an amount of protrusion of the tip end portion of the driver blade 22 from the protruding hole 40*b* is large, so that the nail can be sufficiently driven into the drive-receiving member even if the nail is long. And, at the lower dead point, the piston 21 hits the piston bumper 23. The piston bumper 23 hit by the piston 21 deforms to absorb a part of the excess energy caused after the driving of the piston 21.

Then, when the operator returns the trigger 10, the plunger 123 is returned so that the compressed air is supplied to the head valve chamber 2*g* through the control passage not illustrated. In this manner, the head valve 25 moves downward (to the blocking position). And, the piston upper chamber communicates with an exhaust port not illustrated through an air passage not illustrated, so that the pressure of the piston upper chamber becomes the atmospheric pressure. Accordingly, the compressed air accumulated in the return air chamber 2*e* flows into the piston lower chamber through the air passage 20*b*. In this manner, the piston 21 is pushed upward to return to the initial state as illustrated in FIG. 2.

Next, an operation of the nail driver 1 performed when a relatively short nail is driven will be explained. In this case, the operator performs the rotating operation of the switching knob 60 so that the switching knob 60 is positioned in a state as illustrated in FIG. 6, that is, a state that the protruding portion 60B of the switching knob 60 and the protruding portion 61B of the valve member 61 abut against each other. In this manner, the first air passage 2*b* and the second air passage 2*c* communicate with each other. Therefore, the compressed air inside the accumulator 2*a* flows into the space between the bumper holder 24 and the upper surface of the concave portion 41*b*, and the bumper holder 24 is moved upward by the compressed air, so that the bumper lower chamber 41*c* as illustrated in FIG. 4 is defined. The cylinder 20 moves upward together with the upward movement of the bumper holder 24. However, when the abutting portion 20C of the cylinder 20 abuts against the cylinder place 2D, the upward movements of the bumper holder 24 and the cylinder 20 are stopped so as to restrict the approach of the cylinder 20 to the head valve 25. In the state that the abutting portion 20C has abutted against the cylinder plate 2D, the cylinder 20 is positioned at the upper dead point.

In this state, when the operator pulls the trigger 10 with pressing the push lever 11 onto the drive-receiving member, the head valve 25 moves from the blocking position (FIG. 2) to the distant position (FIG. 8) similarly to the above description. In this manner, as indicated by an arrow in FIG. 8, the compressed air accumulated in the accumulator 2*a* flows from the space between the head valve 25 and the cylinder 20 and acts on the piston 21 so as to push the piston 21 downward. Since the cylinder 20 is positioned at the upper dead point, the position of the cylinder 20 as illustrated in FIG. 8 is closer to the head valve 25 than the position of the cylinder 20 as illustrated in FIG. 7. Accordingly, the area of the opening portion formed between the cylinder 20 and the head valve 25 is small so that an amount of the compressed air acting on the piston 21 is less than an amount in the case that the relatively long fastener is driven (case illustrated in FIG. 7), and therefore, the force of pushing the piston 21 downward (hitting energy of the piston 21 onto the nail) is weak.

And, the piston 21 descends through the cylinder 20 while the driver blade 22 descends through the injection passage 40*a* so as to hit the nail inside the injection passage 40*a*. The piston 21 hits the piston bumper 23 at the lower dead point. The piston bumper 23 hit by the piston 21 deforms to absorb a part of the excess energy caused after the driving of the piston 21. Further, the bumper holder 24 is moved downward by the piston bumper 23, so that the compressed air inside the bumper lower chamber 41*c* absorbs a part of the excess energy of the piston 21. Note that a pressure receiving area of the bumper holder 24 for the compressed air is set to be larger to a suitable extent than an area of the piston 21. At a moment when the piston 21 hits the piston bumper 23, while the bumper holder 24 is moved slightly downward by an impact force at this moment, it is immediately returned upward by the compressed air inside the bumper lower chamber 41*c*.

As described above, in the nail driver 1 according to the first embodiment, the cylinder 20 can be positioned at the lower dead point and the upper dead point which is closer to the head valve 25 than the lower dead point in the state that the valve head 25 moves from the blocking position to the acting position. Therefore, the amount of the compressed air acting on the piston 21, that is, the hitting energy of the piston 21 onto the nail can be switched, so that the driving depth can be adjusted. Accordingly, when the relatively long nail is driven, the cylinder 20 is positioned at the lower dead point to increase the amount of the compressed air acting on the piston 21 which results in the increase in the hitting energy of the piston 21 onto the nail. When the relatively short nail is driven, the cylinder 20 is positioned at the upper dead point to decrease the amount of the compressed air acting on the piston 21 which results in the decrease in the hitting energy of the piston 21 onto the nail. Therefore, when the relatively short nail is driven, by performing the driving operation with positioning the cylinder 20 at the upper dead point, excess driving of the nail can be prevented.

Also, the bumper holder 24 is moved by the compression air to define the bumper lower chamber 41*c* below the bumper holder 24, and therefore, the amount of the protrusion of the driver blade 22 from the injection hole 40*b* can be switched, so that the driving depth of the fastener can be adjusted. Further, the excess energy of the piston 21 caused after the driving is absorbed by the piston bumper 23 and the compressed air inside the bumper lower chamber 41*c*. Therefore, since the amount of the excess energy absorbed by the piston bumper 23 is less than an amount in a case without the bumper lower chamber 41*c*, the wear of the piston bumper 23 is reduced, and noise caused in the hitting is also reduced. Still further, when the cylinder 20 is positioned at the upper dead point, a flowing amount of the compressed air into the cylinder 20 is reduced, and therefore, the driving energy is reduced, and besides, an air consumption amount per nail can be also reduced.

As described above, by performing the rotating operation of the switching knob 60, the communication or the blockage between the first air passage 2*b* and the second air passage 2*c* can be switched, so that the cylinder 20 can be positioned at the upper dead point or the lower dead point. Accordingly, the hitting energy of the piston 21 to the nail can be easily switched, so that the driving depth can be adjusted.

Next, a nail driver 101 according to a second embodiment will be explained with reference to drawings. Note that the same members as those of the first embodiment are denoted by the same numbers and explanations thereof are omitted, and only different portions therefrom will be explained.

Figure 9:
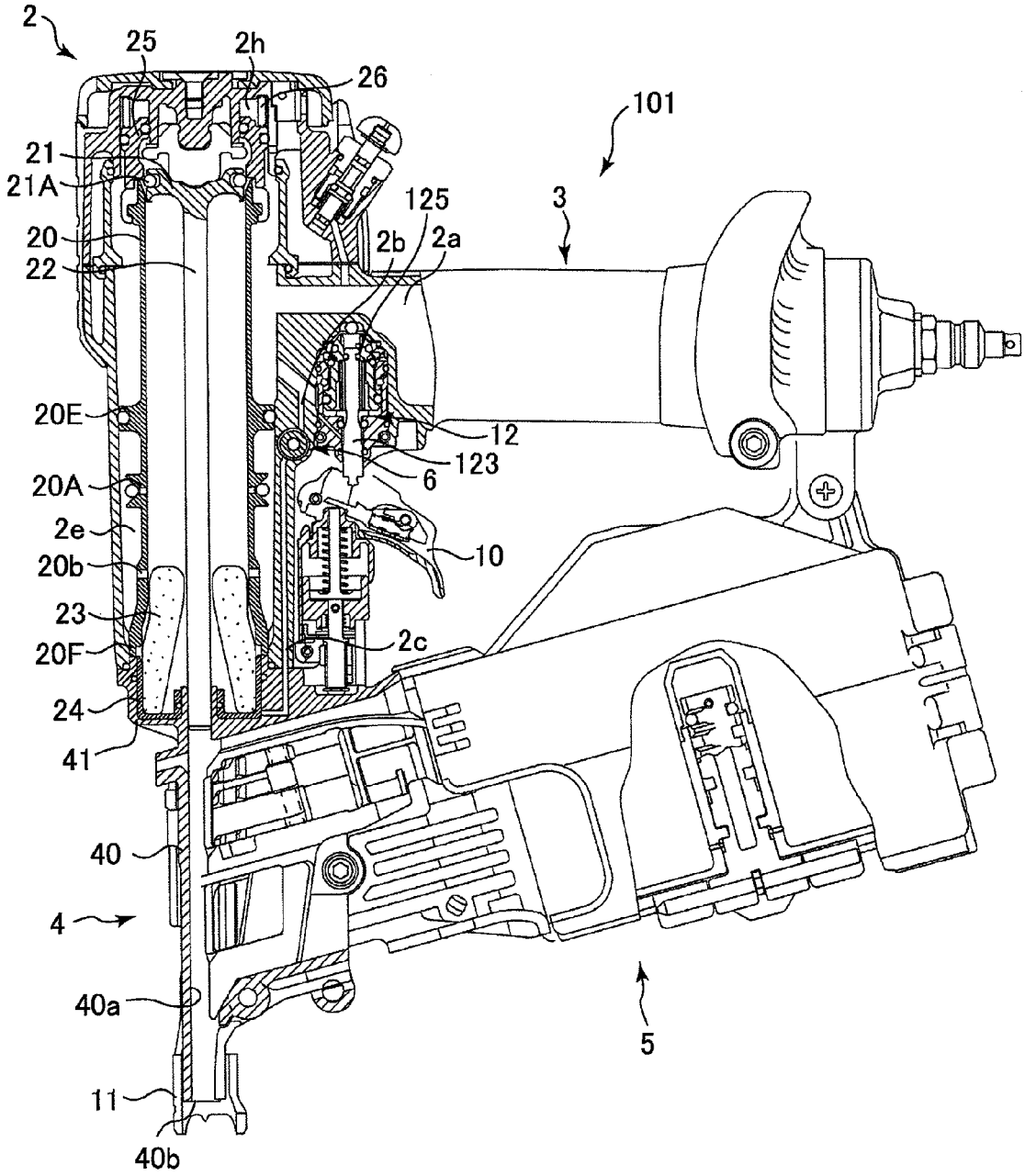
FIG. 9 is a cross-sectional view of a nail driver according to a second embodiment of the present invention.

As illustrated in FIG. 9, a cylinder 20 is provided with a flange portion 20E which protrudes outward in a radial direction from an outer peripheral surface thereof. The flange portion 20E divides a space between the cylinder 20 and a main body 2 into upper and lower spaces, and seals between the upper space and the lower space by an O-ring. The upper space forms an accumulator 2*a* together with a space inside a handle portion 3. Also, the lower space forms a return air chamber 2*e* for storing compressed air for returning the piston 21 to an upper dead point.

Figure 11:
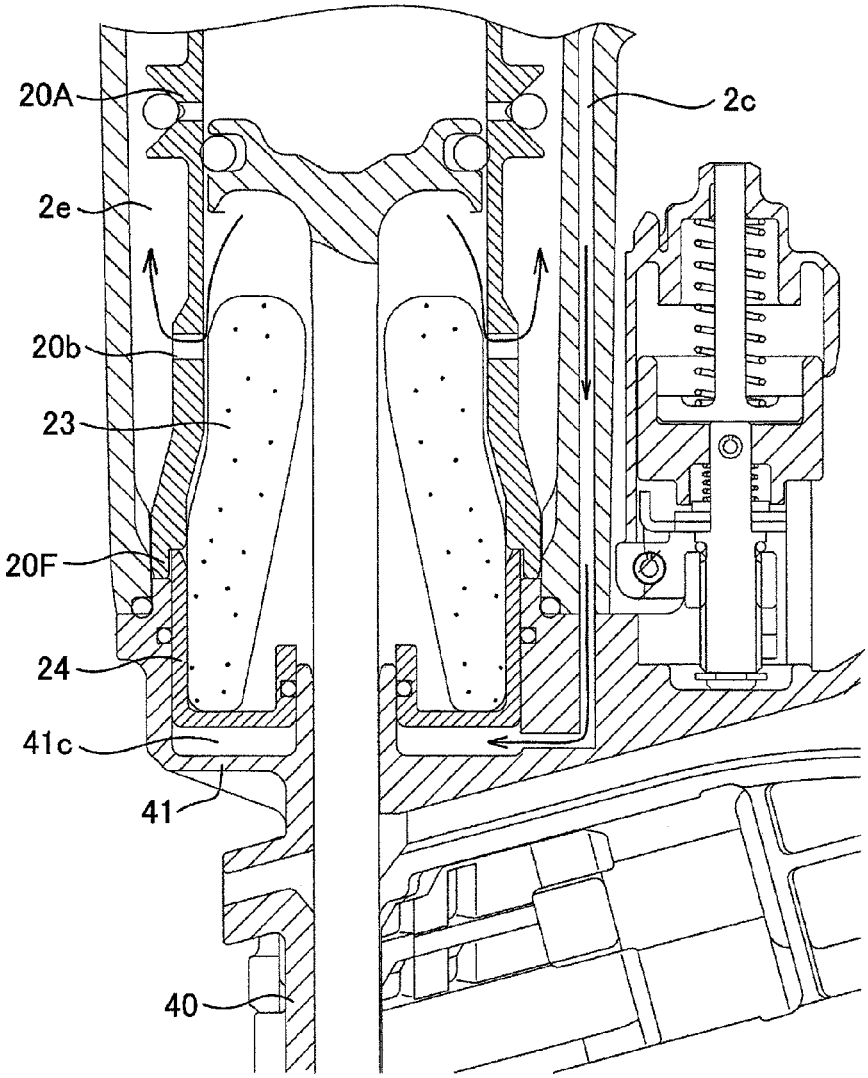
FIG. 11 is an enlarged view of a principal part in a state that the compressed air flows into the bumper lower chamber in the second embodiment.

Further, a lower end portion of the cylinder 20 forms a receiving portion 20F for receiving an upper end portion of a bumper holder 24, and abuts against an upper end of a connecting portion 41. And, the cylinder 20 is pushed downward by an air pressure caused by the compressed air received by the flange portion 20E. As illustrated in FIG. 11, when the bumper holder 24 is moved upward by the compressed air so as to define a bumper lower chamber 41*c*, the upper end portion of the bumper holder 24 is received by the receiving portion 20F, and the bumper holder 24 pushes the cylinder 20 from below. However, a pressure receiving area (lower surface of the bumper holder 24) of the flange portion 20E for the compressed air is larger than a pressure receiving area of the bumper holder 24 for the compressed air, and therefore, the bumper holder 24 does not push the cylinder 20 upward. Therefore, upward movement of the bumper holder 24 is restricted by the receiving portion 20F of the cylinder 20.

Figure 10:
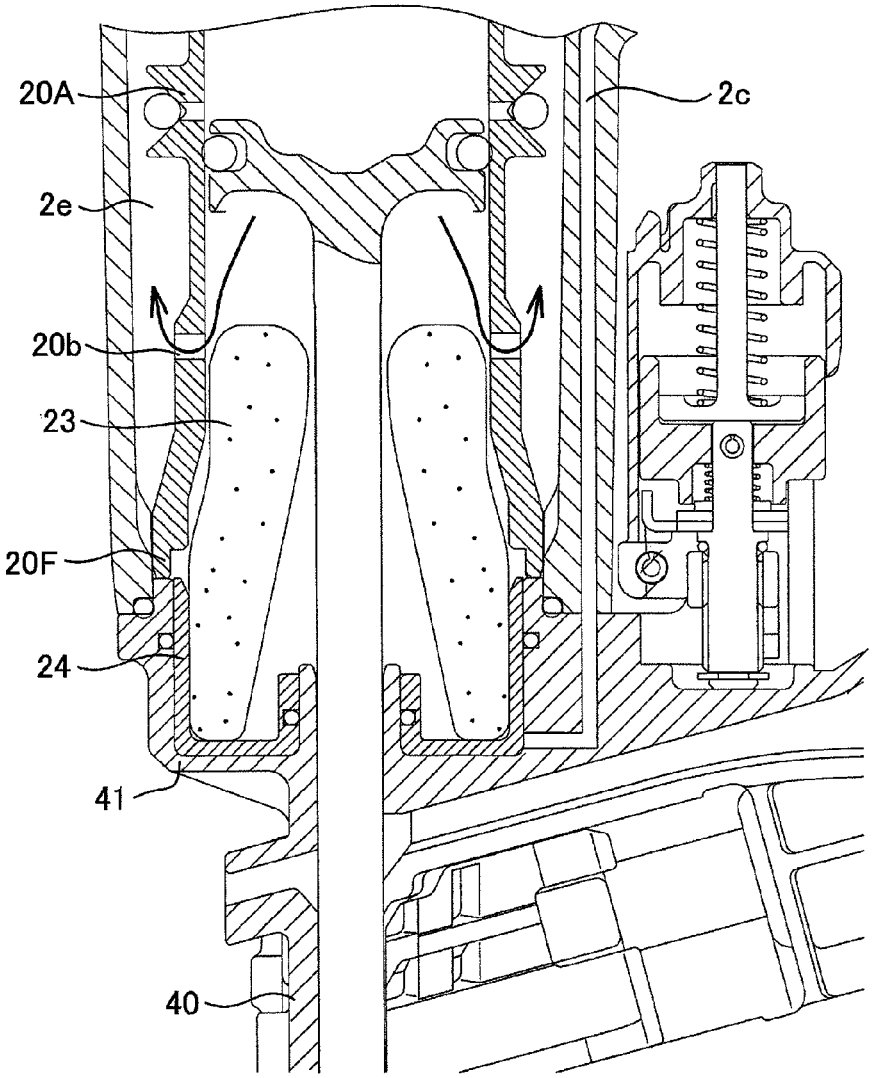
FIG. 10 is an enlarged view of a principal part in a state that no compressed air flows into a bumper lower chamber in the second embodiment.

Still further, in the second embodiment, in a state that the bumper lower chamber 41*c* is not defined as illustrated in FIG. 10, a piston bumper 23 is positioned so as not to restrict exhaust of air from the cylinder 20 to the return air chamber 2*e* caused by the descend of the piston 21. On the other hand, in a state that the bumper lower chamber 41*c* is defined as illustrated in FIG. 11, the piston bumper 23 is positioned at not the position of the piston bumper 23 as illustrated in FIG. 10 but so as to restrict the exhaust of the air from the cylinder 20 to the return air chamber 2*e*. That is, a cross-sectional area of an air passage from the cylinder 20 to an air passage 20*b* as illustrated in FIG. 11 is smaller than a cross-sectional area of an air passage as illustrated in FIG. 10.

Next, an operation of the nail driver 101 according to the present embodiment will be explained.

When a relatively long nail is driven, by performing a rotating operation of a switching knob 60, communication between a first air passage 2*b* and a second air passage 2*c* is blocked so as not to flow the compressed air inside the accumulator 2*a* down below the bumper holder 24. In this state, as illustrated in FIG. 10, the piston bumper 23 and the bumper holder 24 are not moved upward, so that the bumper lower chamber 41*c* is not defined. Accordingly, the piston bumper 23 is positioned so as not to restrict the exhaust of the air from the cylinder 20 to the return air chamber 2*e* caused by the descend of the piston 21.

In this state, when the operator pulls the trigger 10 with pressing the push lever 11 onto the drive-receiving member to move the head valve 25 from a blocking position to a distant position, the piston 21 is pushed downward by the compressed air so that the piston 21 descends through the cylinder 20 while a driver blade 22 descends through an injection passage 40*a*, so that the nail inside the injection passage 40*a* is hit. At this time, the air in the piston lower chamber is not restricted by the piston bumper 23 but flown into the return air chamber 2*e* through the air passage 20*b*. That is, the cross-sectional area of the air passage from the cylinder lower chamber to the return air chamber 2*e* is sufficiently secured, and therefore, a back pressure inside the piston lower chamber is not increased so much.

On the other hand, when a relatively short nail is driven, by performing the rotating operation of the switching knob 60, the first air passage 2*b* and the second air passage 2*c* are communicated with each other so as to flow the compressed air inside the accumulator 2*a* down below the bumper holder 24. In this state, as illustrated in FIG. 11, the piston bumper 23 and the bumper holder 24 are moved upward so as to define the bumper lower chamber 41*c*. Accordingly, the piston bumper 23 is positioned so as to restrict the exhaust of the air from the cylinder 20 to the return air chamber 2*e* caused by the descend of the piston 21.

In this state, when the operator pulls the trigger 10 with pressing the push lever 11 onto the drive-receiving member to move the head valve 25 from the blocking position to the distant position, the piston 21 is pushed downward by the compressed air so that the piston 21 descends through the cylinder 20 while the driver blade 22 descends through the injection passage 40*a*, so that the nail inside the injection passage 40*a* is hit. At this time, the flowing of the air in the piston lower chamber into the return air chamber 2*e* through the air passage 20*b* is restricted by the piston bumper 23. That is, the cross-sectional area of the air passage from the cylinder lower chamber to the return air chamber 2*e* is smaller than the cross-sectional area of the air passage as illustrated in FIG. 10, and therefore, the back pressure inside the piston lower chamber is increased. Accordingly, the hitting energy of the piston 21 to the nail is reduced less than that in the state as illustrated in FIG. 10. Further, in the state as illustrated in FIG. 11, the bumper lower chamber 41*c* is defined, and therefore, the amount of the protrusion of the driver blade 22 from the injection hole 40*b* is reduced less than that in the state as illustrated in FIG. 10.

As described above, in the nail driver 101 according to the second embodiment, the cross-sectional area of the air passage from the cylinder 20 (piston lower chamber) to the return air chamber 2*e* can be switched by the piston bumper 23 and the bumper holder 24. Therefore, the back pressure inside the piston lower chamber in the driving operation, that is, the hitting energy of the piston 21 to the nail therein can be switched, so that the driving depth can be adjusted. Accordingly, when the relatively long nail is driven, the increases in the back pressure inside the piston lower chamber is suppressed without restricting the exhaust of the air from the cylinder 20 to the return air chamber 2*e*, so that the hitting energy of the piston 21 to the nail is increased. When the relatively short nail is driven, the back pressure inside the piston lower chamber is increased with restricting the exhaust of the air from the cylinder 20 to the return air chamber 2*e*, so that the hitting energy of the piston 21 to the nail can be reduced.

Further, also in the nail driver 101 according to the second embodiment, the bumper holder 24 is moved by the compressed air so as to define the bumper lower chamber 41*c* below the bumper holder 24, and therefore, the amount of the protrusion of the driver blade 22 from the injection hole 40*b* can be switched, so that a driving depth of a fastener can be adjusted. Other effects can be achieved similarly to those of the nail driver 1 according to the first embodiment.

Note that the present invention is not limited to the above embodiments, and various modification and application can be achieved. For example, in the above-described second embodiment, the upward movement of the bumper holder 24 is restricted by the receiving portion 20F of the cylinder 20 in the defining of the bumper lower chamber 41*c*. However, at the main body 2 or the connecting portion 41, a member of restricting the upward movement of the bumper holder 24 may be provided. Also, the head valve positioned above the cylinder is employed as one example of a main valve. However, a structure that a main valve is arranged on an upper side surface of the cylinder may be employed.

What is claimed is:

1. A pneumatic nail driver comprising:

a housing in which an air chamber for accumulating compressed air is provided;

a trigger provided in the housing;

a cylinder stored in the housing;

a piston stored to be slidable in the cylinder and driven by the compressed air;

a bumper provided so as to be capable of abutting against the piston;

a bumper holder provided below the bumper and provided to be slidable to the housing while supporting the bumper; and a main valve moving in response to movement of the trigger between an acting position which is distant from the cylinder so that the compressed air acts on the piston and a blocking position which abuts against the cylinder so that the action of the compressed air on the piston is blocked, an air passage extending from the air chamber to the bumper holder being formed in the housing, the cylinder being able to be positioned selectively at either one of a first position and a second position closer to the main valve than the first position in a state that the main valve is at the acting position, and the bumper holder being moved toward the cylinder side by the compressed air from the air passage to define a bumper chamber below the bumper holder, and the cylinder is moved from the first position to the second position by the movement of the bumper holder.

2. The pneumatic nail driver according to claim 1, wherein the cylinder can be moved between the first position and the second position by the compressed air.

3. The pneumatic nail driver according to claim 2, wherein the pneumatic nail driver further includes:

a valve member for opening or closing the air passage; and a switching portion including a switching knob for switching the valve member to a position of opening the air passage or a position of closing the air passage.

4. A pneumatic nail driver comprising:

a housing in which an air chamber for accumulating compressed air and a movement regulating portion are provided;

a trigger provided in the housing;

a cylinder stored in the housing and provided with an abutting portion positioned lower than the movement regulating portion;

a piston stored to be slidable to the cylinder and driven by the compressed air; and a main valve moving in response to movement of the trigger between an acting position which is distant from the cylinder so that the compressed air acts on the piston and a blocking position which abuts against the cylinder so that the action of the compressed air on the piston is blocked, and the cylinder being able to be positioned at either one of a first position and a second position closer to the main valve than the first position in a state that the main valve is at the acting position, and when the cylinder is at the second position, the abutting portion abuts against the movement regulating portion to regulate approach of the cylinder to the main valve.

* * * * *